United States Patent [19]

Lindquist

[11] Patent Number: 4,902,938

[45] Date of Patent: Feb. 20, 1990

[54] ELECTRONIC BALLAST WITH HIGH VOLTAGE PROTECTION

[75] Inventor: John Lindquist, Larkspur, Calif.

[73] Assignee: MagneTek Inc., Del.

[21] Appl. No.: 98,580

[22] Filed: Sep. 18, 1987

Related U.S. Application Data

[63] Continuation-in-part of Ser. No. 798,265, Nov. 15, 1986, Pat. No. 4,700,113.

[51] Int. Cl.[4] ..... H05B 41/36

[52] U.S. Cl. ..... 315/307; 315/224; 315/DIG. 7

[58] Field of Search ..... 315/307, 308, 224, DIG. 7

[56] References Cited

U.S. PATENT DOCUMENTS 4,700,113 10/1987 Stupp et al. ..... 315/DIG. 7

*Primary Examiner*—David Mis

*Attorney, Agent, or Firm*—Darby & Darby

[57] ABSTRACT

A solid-state ballast for discharge lamps includes circuitry for limiting the maximum output voltage produced when a lamp is first being ignited or is removed. The ballast includes a signal controlled oscillator that provides the operating signal for a resonantly driven lamp load. The voltage across the load is sensed and a signal representing this voltage is fed back to a circuit when controlling the oscillator so as to limit the maximum load voltage during initial start-up and when a lamp is removed. In accordance with a second embodiment, the voltage is cycled between a low level and a level high enough to ignite the lamp, so long as the lamp is not ignited.

21 Claims, 3 Drawing Sheets

10
102
74
V+
T2
51
40
44
42
48
46
20
22
ONE SHOT
24
26
28
100
70
25
104
116
114
112
108
110
106
VREF.1
83
89
87
85
81
76
84
82
78
80
VREF.2
72

ELECTRONIC BALLAST WITH HIGH VOLTAGE PROTECTION

The present patent application is a continuation-in-part of my patent application Ser. No. 798,265 filed Nov. 15, 1986.

FIELD OF THE INVENTION

The present invention relates generally to an electronic ballast for gas discharge lamps and, more particularly, concerns a ballast which avoids the build-up of excessively high voltages during star-up of the lamps or when a lamp is removed.

BACKGROUND OF THE INVENTION

Prior to ignition, gas discharge lamps present a substantially higher impedance to the drive circuits of an electronic ballast than they do during steady-state operation. The removal of one or more lamps from the ballast would similarly result in an increased impedance level. Such high impedance levels could result in the production of dangerously high voltages within the electronic ballast. Such voltages, particularly if they are sustained at a high level for any period of time, could result in breakdown and destruction of solid-state components, or the electrocution of an individual attempting to change a lamp.

It is therefore an object of the present invention to avoid excessively high voltages in an electronic ballast for discharge lamps when a lamp is removed from the ballast, or during start-up, prior to the firing of the lamps.

It is also an object of the present invention to provide a solid-state ballast which is reliable and convenient in use, yet relatively simple and inexpensive in construction.

In accordance with an illustrative embodiment demonstrating objects and features of the present invention, a solid-state ballast for discharge lamps includes a signal controlled oscillator that provides the operating signal for a resonantly driven lamp load. The voltage across the load is sensed and a signal representing this voltage is fed back to a circuit which controls the oscillator so as to limit the maximum load voltage during initial start-up and when a lamp is removed. In accordance with a second embodiment, the voltage is cycled between a low level and a level high enough to ignite the lamp, so long as the lamp is not ignited.

BRIEF DESCRIPTION OF THE DRAWING

The foregoing brief description, as well as further objects, features and advantages of the present invention will best be understood from the following description of a presently preferred, but nonetheless illustrative, embodiment of the present invention, with reference being had to the drawing, wherein.

DETAILED DESCRIPTION OF THE PREFERRED EMBODIMENT

Figure 1:
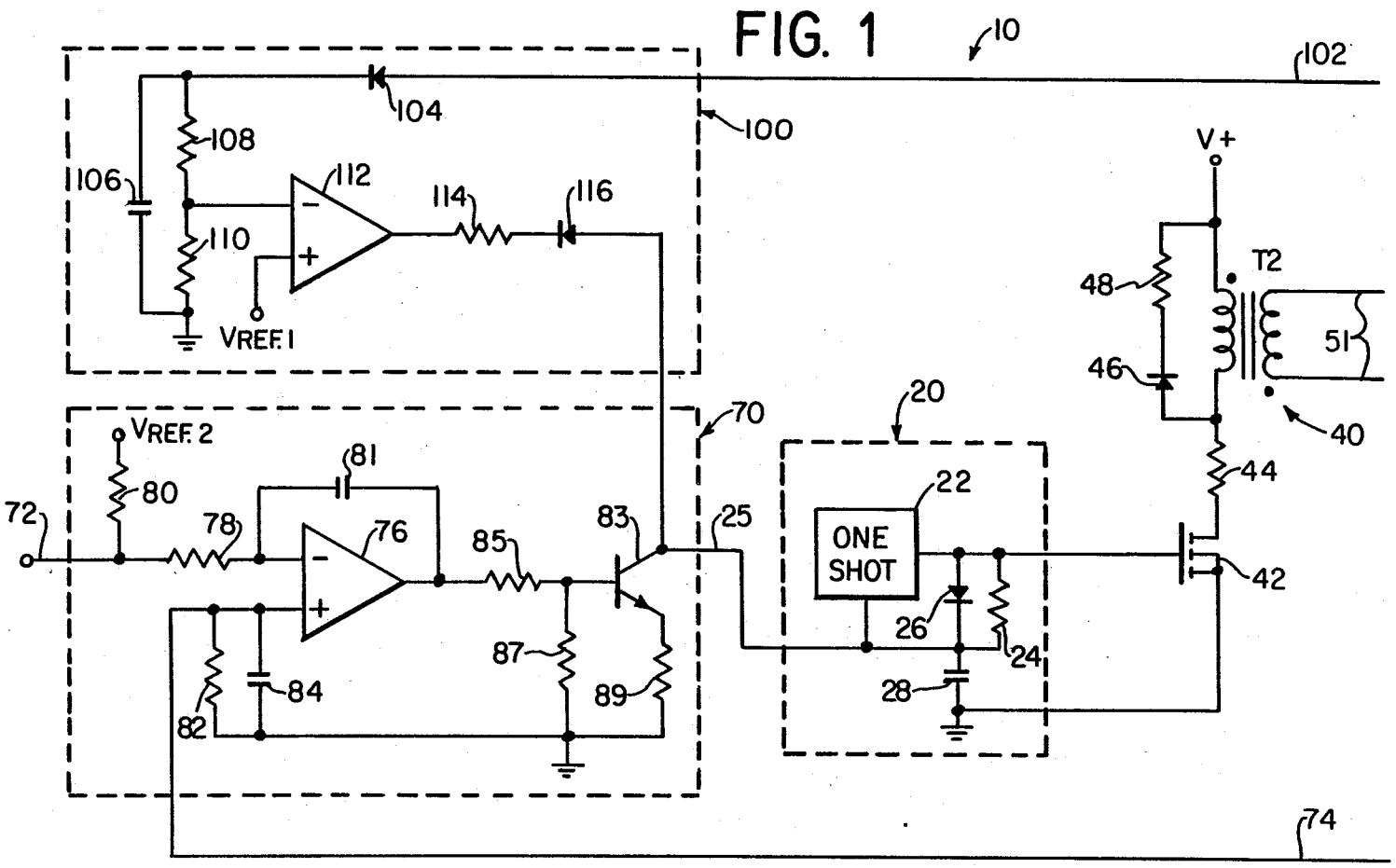
FIGS. 1 and 2, in combination, comprise a schematic circuit diagram of a solid-state ballast incorporating the present invention.
Figure 2:
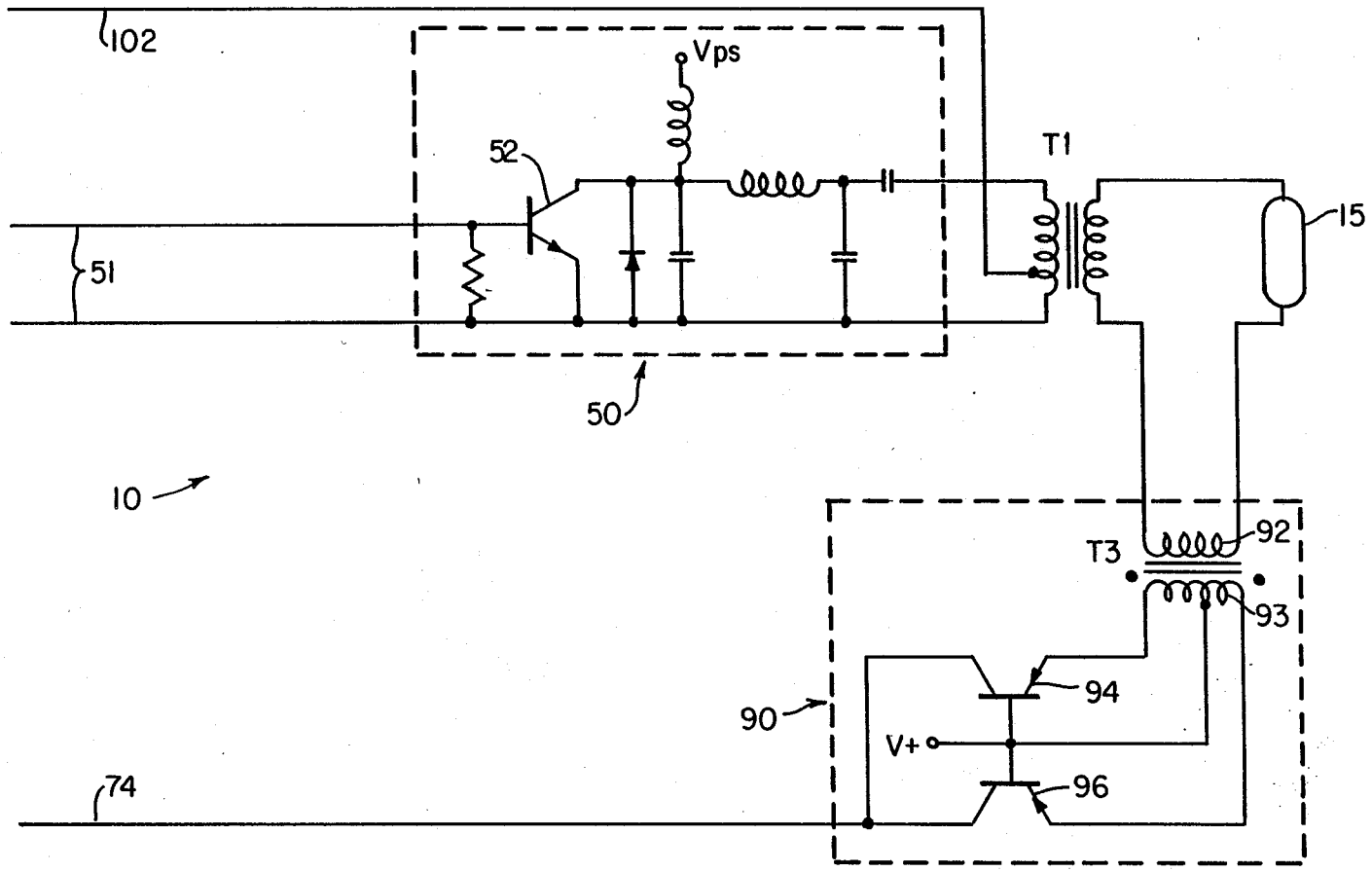

Turning now to the details of the drawing, FIGS. 1 and 2 together comprise a simplified circuit schematic diagram of a preferred embodiment of the invention incorporated in an electronic ballast, 10, for discharge lamps. In FIG. 1, the details of all DC power supplies have been omitted, it being assumed that some conventional form of well-regulated power supply would be employed and would be used not only to provide operating drive current for the load, but also to derive voltage levels for operating the electronics. Preferably, the power supply would derive its energy from the AC power line.

The electronic ballast 10 broadly comprises: a signal controlled oscillator 20 providing a nominal operating signal of about 30 kHz; a drive circuit 40 coupling the oscillator signal to a resonant power amplifier 50 which is coupled, through a transformer T1, to a load 15 comprising one of more gas discharge lamps; an illumination control circuit 70 responsive to an external control signal to control the frequency of signal controlled oscillator 20; a load current sensor 90, which is feedback coupled to illumination control circuit 70; and a start-up control circuit 100, which is coupled to regulate signal controlled oscillator 20, under feedback control from transformer T1.

In operation, signal controlled oscillator 20 provides a high frequency signal to drive the load 15 via power amplifier 50 through transformer T1. During initial start-up and when one or more lamps are removed, start-up control circuit 100 acts on signal controlled oscillator 20 to modify its frequency so that the voltage presented to the load is maintained below a predetermined open-circuit voltage level. After all the lamps in the load have been ignited, start-up control circuit 100 remains inactive, unless a lamp is removed. During normal operation, illumination control circuit 70 controls the frequency of signal controlled oscillator 20 and, therefore, the amount of current provided to the load. This load current is sensed by load current sensor 90, which provides a feedback signal to illumination control circuit 70. This results in a load current feedback control loop, which maintains the load current under close regulation. The actual value of the load current, and therefore the brightness of the illumination produced by the lamps in the load, can be regulated by an external control signal applied to illumination control circuit 70.

Signal controlled oscillator 20 includes a "one-shot" circuit 22, a resistor 24, a diode 26, and a capacitor 28. It is characteristic of the one-shot circuit that it will produce a positive pulse of predetermined duration at its output O, upon being triggered with a sufficiently negative voltage level applied to its trigger input T. The diode 26 is connected in a forward direction between the output and trigger input of one-shot 22, and the resistor 24 is connected in parallel across the diode. The capacitor 28 is connected between the trigger input of one-shot 22 and ground. In addition, signals external to signal controlled oscillator 20 may be applied to the trigger input of one-shot 22 via lead 25.

In operation, diode 26 turns on whenever one-shot 22 produces a pulse, whereby capacitor 28 is rapidly charged to the peak level of the pulse. When the pulse of one-shot 22 terminates, diode 26 turns off and capacitor 28 begins to discharge through resistor 24. When the voltage across capacitor 28 reaches the threshold level of one-shot 22, the one-shot is retriggered. The delay between the termination of the pulse at the output of one-shot 22 and the re-triggering of the one-shot is determined by the values of resistor 24 and capacitor 28, as well as any external signals applied to lead 25. By selecting the values of resistor 24 and capacitor 28 and controlling the current flow in lead 25, it is possible to control precisely the re-triggering delay of one-shot 22. Since the output pulse duration of the one-shot is known, this will result in precise control of the output frequency of signal controlled oscillator 20.

One-shot 22 is preferably realized with a conventional timer circuit, such as an RCA CA555 timer. A one-shot circuit is a convention configuration for such a timer.

Driver 40 is a conventional "flyback" circuit. It includes a field effect transistor 42 acting as a switch, a current limiting resistor 44 connected in series with the primary of a transformer T2, and a diode 46 connected in series with a resistor 48 across the primary of the transformer. The secondary of the transformer is wound so that it produces a signal reversal with respect to the primary.

In operation, transistor 42 is turned on by each pulse at the output of signal controlled oscillator 20, and it turns off when the pulse terminates. As a result of the signal inversion produced at the secondary of the transformer, when transistor 42 turns on, transistor 52 is turned off. Transistor 42 continues to draw current through the primary of T2 until it is turned off by oscillator 20. Then, the current drawn through the primary of T2 decreases rapidly, inducing a voltage in the secondary which turns on transistor 52. The value of resistor 44 determines the current flow in transistor 42, diode 46 prevents excessively large transients at the drain of transistor 42, which could damage the transistor and resistor 48 limits the current flow in diode 46.

Power amplifier 50 is a known type of tuned, switching power amplifier described in "Class E- A New Class of High-efficiency Tuned Single-ended Switching Power Amplifiers", Nathan O. Sokal, et al., Vol. SC-10, No. 3, IEEE Journal of Solid-state Circuits (June 1975). This amplifier is designed to operate resonantly in such a manner that the collector current of transistor 52 is minimal when the collector-to-emitter voltage is non-zero, and so that the collector-to-emitter voltage is minimal when collector current flows. By design, the resonant frequency of the amplifier corresponds to the nominal frequency of signal controlled oscillator 20.

Illumination control circuit 70 receives an external control signal via lead 72. Circuit 70 also receives a current control signal which is fed back via lead 74 from load current sensor 90. Within illumination control circuit 70, the external control signal is fed to the inverting input of a differential input operational amplifier 76 through a resistor 78. In addition, an internally generated reference voltage $V_{REF2}$ is applied to the inverting input of amplifier 76 via resistors 80 and 78. The signal fed back via lead 74 from load current sensor 90 is applied to the non-inverting input of amplifier 76, and the resistor 82 and capacitor 84 are connected between the non-inverting input and ground. The output of amplifier 76 is fed back to the inverting input through a capacitor 81, and is also applied to the base of a transistor 83 through a resistor divider 85, 87. The emitter of transistor 83 is connected to ground through a current-determining resistor 89, and the collector of the transistor is connected to signal controlled oscillator 20 via lead 25.

In operation, $V_{REF2}$ is utilized to maintain the illumination of the load at a predetermined level, in the absence of an external control signal. This predetermined level of illumination can be modified by applying an external control signal to lead 72, preferably in the form of a pulse width modulated signal. The value of capacitor 81 is selected so as to provide a filtering effect with respect to the pulse with modulated signal on lead 72, whereby the signal at the inverting input of amplifier 76 is a weighted sum of $V_{REF2}$ and the DC level of the external control signal.

The current feedback signal on lead 74 produces a voltage at the non-inverting input of amplifier 76, the amplitude of which depends upon the amplitude of the output current provided to the load. Capacitor 84 averages the signal from load current sensor 90, to produce a d.c. voltage. As is well-known, the overall effect of the feedback loop will be to make the voltages on the inverting and non-inverting inputs of amplifier 76 equal. As will be understood from the discussion which follows, this has the effect of maintaining the load current constant in amplitude.

Should the voltage at the non-inverting input of amplifier 76 momentarily exceed the voltage at the inverting input, an error voltage would be produced at the output of the amplifier, which would be fed, in attenuated form, to the base of transistor 83. This produces a current in the emitter of transistor 83, the value of which is determined by the value of resistor 89. This same current is drawn by the collector of transistor 83 from the lead 25. In signal controlled oscillator 20, the current drawn by the collector of transistor 83 from the lead 25 contributes to the rate at which capacitor 28 is discharged. The overall effect is to shorten the duration of a cycle of signal controlled oscillator 20, thereby increasing its frequency. This frequency shift causes the oscillator signal to move beyond the center of the resonance band of power amplifier 50, whereby the amplitude of the signal driving the load 15 is reduced. From this description, it will be clear that the feedback loop compensates for changes in the drive signal to the load, thereby maintaining the current supplied to it, and therefore the illumination, constant.

Load current sensor 90 includes a transformer T3 having a primary winding 92, through which the load current flows. The secondary winding 93 of transformer T3 has a current induced in it which is proportional to the current in primary 92. The secondary 93 of transformer T3 has a center tap which is connected to the bases of transistors 94 and 96 and to the power supply V+ for the electronics. The opposite ends of secondary 93 are connected to the emitters of transistors 94 and 96, respectively.

By design, the load current is essentially sinusoidal, as a result of the resonant operation of power amplifier 50. The two halves of secondary 93 are oppositely poled and each drives the emitter of a common base transistor. Hence, transistors 94 and 96 will respond to opposite half-cycles of the load current. Owing to the high impedance levels present at the collectors of transistors 94 and 96, these collectors appear essentially as current sources. By connecting the two collectors together, their currents are combined, and a composite current source is obtained which provides a current, on lead 74, which is a full-wave rectified replica of the load current. As explained above, this current is utilized in illumination control circuit 70 to achieve feedback control by smoothing the rectified signal to produce a D.C. voltage.

Via a tap on the primary of transistor T1, a portion of the load voltage is fed back to start-up control circuit 100 via lead 102. Within circuit 100, this signal is applied through a diode 104 and a capacitor 106 to ground. The combination of the diode and capacitor is a peak detector, so that a voltage appears across the capacitor 106 which is proportional to the peak value of the drive voltage on transformer T1. A portion of this voltage is fed via a resistor divider 108, 110 to the inverting input of a differential operational amplifier 112. The non-inverting input of amplifier 112 is connected to an internally generated reference voltage $V_{REF1}$, and the output of the amplifier is coupled through a resistor 114 and diode 116 to lead 25.

In operation, the output of amplifier 112 is maintained at a high level, unless the voltage at the inverting input exceeds $V_{REF1}$. This will occur only prior to the ignition of the lamp(s) comprising the load or if one or more lamps are removed. When the voltage at the inverting input does exceed $V_{REF1}$, the output of amplifier 112 is driven low, diode 116 is turned on, and this low level is coupled to lead 25. This results in rapid discharge of capacitor 28 in signal controlled oscillator 20, whereby the operating frequency of the oscillator is substantially increased. Through the feedback loop including control circuit 100, the voltage applied to the load is reduced to a safe level, at which transistor 52 is not in danger of being damaged. Furthermore, under open circuit conditions, the output voltage is maintained at level sufficient to ionize lamps.

From the preceding paragraph, it is understood that the signal on lead 25 is essentially a composite control signal which is produced in response to the signal on lead 74 (a first control signal) and the signal produced by circuit 100 (a second control signal). When the voltage on lead 102 is not excessive, the composite control signal on lead 25 is essentially determined by the signal on lead 74. However, when the voltage on lead 102 is excessive, amplifier 112 acting through diode 116 pulls the signal on lead 25 to a nominal low voltage so as to reduce the voltage across the load.

Figure 3:
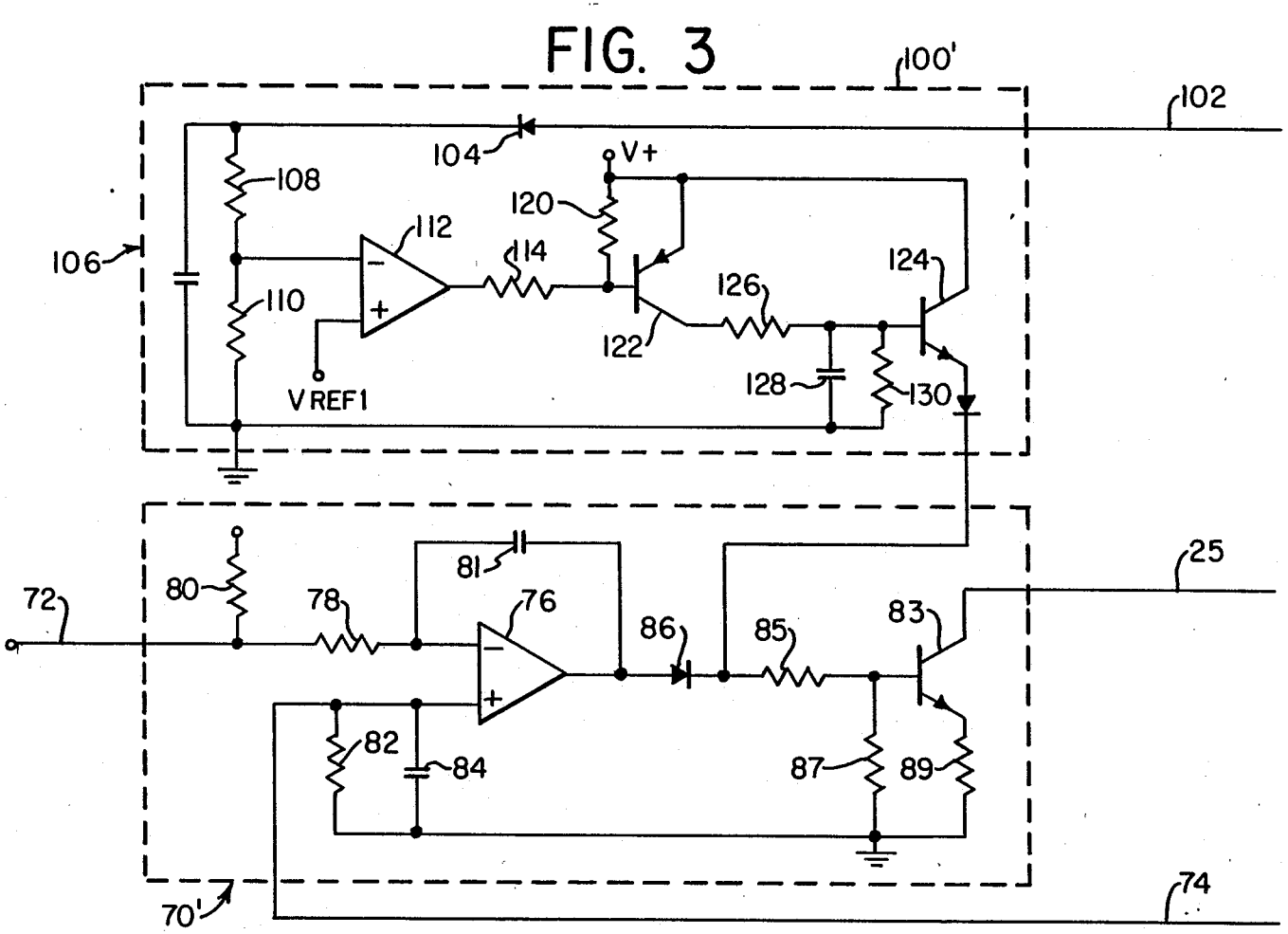
FIG. 3 is a schematic diagram illustrating alternate versions of start-up control circuit 100 and illumination control circuit 70, which produce the aforementioned voltage cycling until the lamp is ignited.

FIG. 3 illustrates an alternate embodiment 70' of illumination control circuit 70 and an alternate embodiment 100, of start-up control circuit 100. These alternate embodiments are assumed to be substituted in the system represented by the schematic diagram composed of FIGS. 1 and 2. Illumination control circuit 70' is identical in structure and function to illumination control circuit 70, except for the addition of diode 86, for a purpose to be discussed below. In addition, start-up control circuit 100' is connected between diode 86 and resistor 85, instead of being connected directly to lead 25.

In start-up control circuit 100', certain components have been identified with the same referenced characters as the corresponding components in start-up control circuit !00. These components are identical in structure and function to these components identified by the same referenced characters and will not be discussed further. In addition to those elements present in start-up control circuit 100, start-up control circuit 100' also includes a resistor 120 connected between resistor 114 and the power supply V+. The base of a PNP transistor 122 is connected to the junction of resistors 114 and 120, and the emitter of the transistor is connected to the power supply V+. The collector of transistor 122 is connected to the base of a transistor 124 through a resistor 126, and the base of transistor 124 is further connected to ground through the parallel connection of a capacitor 128 and a resistor 130. The collector of transistor 124 is connected to the power supply V+, and the emitter of the transistor is connected to illumination control circuit 70' through a diode 130.

As was the case with start-up control circuit 100, the output of comparator amplifier 112 is maintained at a high level, unless the voltage at the inverting input exceeds $V_{REF1}$. This occurs only prior to the ignition of the lamp(s) comprising the load or if one or more are removed. When the voltage at the inverting input does exceed $V_{REF1}$, the output of amplifier 112 is driven low, and the resulting voltage drop across resistor 120 causes transistor 122 to be turned on.

With transistor 122 turned on, capacitor 128 is charged towards the power supply of V+. By design, the voltage of the base of transistor 124 achieves a relatively high level, and this high level also appears at the remitter of the transistor. The voltage is substantially higher than the voltages which normally appear at the output of amplifier 76, so that diode 86 is reverse biased and diode 130 is forward biased. This isolates amplifier 76 from resistor 85 and connects transistor 124 to that resistor.

Transistor 124 then functions as an emitter-follower and acts as a buffer amplifier between the capacitor 128 and the resistor 85. The high voltage across capacitor 128 is therefore applied to resistor 85 and, through the voltage divider action of resistors 85 and 87, a predetermined proportion of this voltage is applied to the base of transistor 83. This produces a current in the emitter of transistor 83, the value of which is determined by the value of resistor 89. This same current is drawn by the collector of transistor 83 through the lead 25. In signal controlled oscillator 20, the current drawn by lead 25 produces a substantial increase in frequency, whereby the amplitude of the signal driving the load 15 is reduced to a nominal minimum value.

With the voltage across the load reduced to a minimum value, the voltage fed back to the inverting input of amplifier 112 become less than the voltage $V_{REF1}$, so that the output of amplifier 112 goes high and transistor 122 is turned off. Capacitor 128 is then discharged through resistor 130 at a relatively slow rate determined by the values of the capacitor and the resistor. As the voltage across capacitor 128 decreases, the voltage applied through transistor 124 to resistor 85 follows and a corresponding, time-decreasing current is produced on lead 25 by transistor 83. This produces a gradual reduction in the frequency of signal controlled oscillator 20 and a corresponding gradual increase in the amplitude of the signal driving the load 15.

Eventually, the signal driving the load reaches a high enough level so that the signal appearing at the inverting input of amplifier 112 exceeds the $V_{REF1}$. Consequently, the output of amplifier 112 once against goes low, and the cycle of operation described above repeats.

From the preceding discussion, it will be appreciated that start-up control circuit 100' causes the voltage across the load to increase gradually from a minimum level to a maximum level, at which time the voltage suddenly returns to the minimum level and this cycle of operation repeats. By design, the maximum level of the voltage is selected to be high enough to ionize the lamp(s) load 15. When the lamp(s) load is ignited, the cycled operation produced by start-up control circuit 100' is terminated.

It is a feature of the present invention that cycling of the voltage across the load causes the load voltage to be at its maximum value for a relatively short time, whereby heating in the output stages is minimized.

Preferably, amplifier 112 is operated so that its output is triggered into a low state when the ballast is first turned on. This causes the low voltage to start at its minimum value and to rise gradually therefrom. Consequently, start-up control circuit 100, automatically achieves the slow start sequence required by ionized tube lamps.

When the lamp(s) load is not present, the amplified voltage provided by the ballast cycles continuously. Consequently, lamps may be changed while the power is on with much less damage that might occur in a ballast which maintains the output voltage at its maximum value.

Although a preferred embodiments of the invention have been disclosed for illustrative purposes, those skilled in the art will appreciate that many additions, modifications, and substitutions are possible, without departing from the scope and spirit of the invention as defined by the accompanying claims.

What is claimed is:

1. In a solid-state ballast for discharge lamps, the ballast being of the type including an oscillator providing an operating signal to the discharge lamp load through a driver, the improvement comprising:

said oscillator being a signal controlled oscillator having a frequency control input and providing an output signal with a frequency determined by the value of a signal applied at said frequency control input;

control means sensing the instantaneous current flowing within the load for producing a first control signal representing this load current;

comparator means differentially responsive to the voltage across the load and a predetermined reference voltage for producing a second control signal representing the polarity of the difference between said voltages, said reference voltage corresponding to a load voltage substantially in excess of the voltage across a normally discharging lamp;

coupling means jointly responsive to said first and second control signals for producing a composite control signal to said frequency control input, said composite control signal being substantially identical to said first control signal when said second control signal has a polarity indicating that the load voltage is not excessive, said composite control signal being equal to a predefined signal when said second control signal has polarity indicating that the load voltage is excessive, said predefined signal being effective to operate said oscillator so as to reduce the voltage across said load to a predetermined minimum value.

2. A ballast in accordance with claim 1, wherein said coupling means comprises:

means jointly responsive to said composite control signal and an externally provided brightness level signal for differentially processing said signals to produce an error signal; and means for providing said error signal to said frequency control input.

3. A ballast in accordance with claim 1, wherein said signal controlled oscillator comprises:

a one-shot circuit having an output providing a pulse of predetermined duration and an input for triggering the initiation of said pulse;

delay means connecting said output of said one-shot to the input thereof; and means coupling said one-shot out put as the output signal of said oscillator.

4. A ballast in accordance with claim 3, wherein said coupling means comprises:

means jointly responsive to said composite control signal and an externally provided brightness level signal for differentially processing said signals to produce an error signal; and means for providing said error signal to said frequency control input.

5. A ballast in accordance with claim 3, wherein said delay means comprises a capacitor and a resistor connected in series circuit between said one-shot output and a voltage source, a diode connected in parallel circuit with said resistor, and means connecting the junction of said resistor and said capacitor to said one-shot input.

6. A ballast in accordance with claim 4, wherein said means for differentially processing comprises a differential amplifier having said brightness level signal applied to the noninverting input and the composite control signal to the inverting input.

7. A ballast in accordance with claim 4, further comprising means for generating a brightness reference voltage and means for forming a weighted average between said brightness reference voltage and said brightness level signal, said means for differentially processing being a differential amplifier having said weighted average applied to the noninverting input and the composite control signal to the inverting input.

8. A ballast in accordance with claim 2, wherein said means for differentially processing comprises a differential amplifier having said brightness level signal applied to the noninverting input and the composite control signal to the inverting input.

9. A ballast in accordance with claim 2, further comprising means for generating a brightness reference voltage and means for forming a weighted average between said brightness reference voltage and said brightness level signal, said means for differentially processing being a differential amplifier having said weighted average applied to the noninverting input and the composite control signal to the inverting input.

10. A ballast in accordance with claim 1, wherein said means for producing a first control signal comprises means for generating a full-wave rectified replica of said load current.

11. A ballast in accordance with claim 1, wherein said means for producing a first control signal comprises:

a transformer having a primary winding in series circuit with said load and a secondary winding which is center tapped, the two parts of said secondary being wound so as to be oppositely poled;

first and second transistors having their bases and their collectors connected together, the emitters thereof being connected to connected opposite ends of said secondary winding, said interconnected bases being also connected to said center tap and a voltage source, said first control signal being produced at said interconnected collectors.

12. A ballast in accordance with claim 1, further comprising means for coupling the voltage across said load to said frequency control input.

13. A ballast in accordance with claim 9, wherein said voltage coupling means comprises means for peak detecting the load voltage and means differentially responsive to said peak detected voltage and an action signal coupled to said frequency control input.

14. A ballast in accordance with claim 10, wherein said action signal is coupled to said frequency control input through a diode.

15. A ballast in accordance with claim 2, wherein said means for producing a first control signal comprises means for generating a full-wave rectified replica of said load current.

16. A ballast in accordance with claim 2, wherein said means for producing a control signal comprises:

a transformer having a primary winding in series circuit with said load and a secondary winding which is center-tapped, the two parts of said secondary being wound so as to be oppositely poled;

first and second transistors having their bases and their collectors connected together, the emitters thereof being connected to connected opposite ends of said secondary winding, said interconnected bases being also connected to said center tap and a voltage source, said first control signal being produced at said interconnected collectors.

17. A ballast in accordance with claim 2, further comprising means for coupling the voltage across said load to said frequency control input.

18. A ballast in accordance with claim 16, wherein said voltage coupling means comprises means for peak detecting the load voltage and means differentially responsive to said peak detected voltage and an action signal coupled to said frequency control input.

19. A ballast in accordance with claim 17, wherein said action signal is coupled to said frequency control input through a diode.

20. A ballast in accordance with claim 1, wherein said predefined signal is a fixed level.

21. A ballast in accordance with claim 1, further comprising means for generating said predefined signal as a waveform which is initially at a value calculated to produce said minimum load voltage, said waveform gradually varying to a value which is calculated to produce a load voltage which is excessive, the load voltage being then returned to said minimum value, whereby the load voltage is caused to cycle between the minimum value and an excessive value.

* * * * *